US010143293B2

(12) United States Patent
Song et al.

(10) Patent No.: US 10,143,293 B2
(45) Date of Patent: Dec. 4, 2018

(54) BAG

(71) Applicant: NEPA Co., Ltd., Seoul (KR)

(72) Inventors: Suk Kyoo Song, Seoul (KR); Kyoung Mi Park, Seoul (KR)

(73) Assignee: NEPA Co., Ltd., Seoul (KR)

( * ) Notice: Subject to any disclaimer, the term of this patent is extended or adjusted under 35 U.S.C. 154(b) by 4 days.

(21) Appl. No.: 15/185,029

(22) Filed: Jun. 17, 2016

(65) Prior Publication Data

US 2017/0360182 A1 Dec. 21, 2017

(51) Int. Cl.
*A45F 3/02* (2006.01)
*A45F 3/00* (2006.01)

(52) U.S. Cl.
CPC ..... *A45F 3/005* (2013.01); *A45F 3/02* (2013.01)

(58) Field of Classification Search
CPC ..... A45F 3/047; A45F 3/14; A45F 2003/142; A45F 5/004
USPC ..... 224/162
See application file for complete search history.

(56) References Cited

U.S. PATENT DOCUMENTS 5,072,867 A * 12/1991 Zingale ..... A45F 3/02 224/162
5,294,029 A * 3/1994 Shimura ..... A45C 5/00 150/108
5,881,932 A * 3/1999 Wadden ..... A45F 3/02 150/108
6,053,381 A * 4/2000 Fahl ..... A45F 3/047 150/108
7,600,660 B2 * 10/2009 Kasper ..... A44B 11/065 2/338
2009/0212082 A1 * 8/2009 Bautista ..... A45C 13/30 224/257

FOREIGN PATENT DOCUMENTS

KR 20-0189053 Y1 7/2000
KR 20-2012-0005148 U 7/2012

* cited by examiner

*Primary Examiner* — Adam Waggenspack
(74) *Attorney, Agent, or Firm* — Revolution IP, PLLC

(57) ABSTRACT

Disclosed herein is a bag configured such that the length of a bag strap used to hold the bag on a user's body is easily adjustable and an adjusted region is not exposed to the outside, thus enabling a neat appearance to be reliably maintained and allowing the bag to be safely used. The bag includes a sack-shaped main body configured to receive objects and a bag strap normally connected to the main body and used to hold the bag on a user's shoulder, waist or the like. One end of the bag strap is coupled to one end of the main body, a wire of a predetermined length is connected to the other end of the bag strap, and the main body includes an adjusting means that adjusts the length of the wire by winding or unwinding, in the state where an end of the wire is fixed.

4 Claims, 6 Drawing Sheets

BAG

BACKGROUND OF THE INVENTION

1. Field of the Invention

The present invention relates generally to a bag that contains objects therein to carry and convey them. More particularly, the present invention relates to a bag configured such that the length of a bag strap used to hold the bag on a user's body is easily adjustable and an adjusted region is not exposed to the outside, thus enabling a neat appearance to be reliably maintained and allowing the bag to be safely used.

2. Description of the Related Art

Generally, a bag is a storage and conveyance article that is held on a user's body by being hung over a user's shoulder or being worn on the user's back via a strap.

Such a bag has various shapes and sizes depending on its purpose or user preferences. The bag basically includes a sack-shaped main body configured to receive objects therein, and a bag strap normally connected to the main body and held on a user's shoulder, waist or the like.

That is, objects are received in the main body and then are stored or conveyed by carrying the bag using the bag strap.

An opening is famed in the main body to put in or take out objects from an internal space of the main body, which has an opening and closing element, such as a Velcro fastener or a slide fastener provided to open or close the opening.

The bag strap may comprise a pair of straps or a single strap. The pair of straps extends from both ends of the main body, respectively, to be held on and released from the body. The single strap is configured such that both ends thereof connect to the main body.

Moreover, the bag strap is provided with an adjusting means for adjusting the length of the bag strap, whereby the strap can be adjusted to a length suitable for a user's body.

As one example of the adjusting means for adjusting the length of the bag strap, a buckle structure has been proposed. Korean U.M. Registration No. 20-0189053, entitled Belt Device, discloses a bag with a buckle structure that is applied to the bag to fasten bag straps and simultaneously adjust the length thereof.

Further, Korean U.M. Application Publication No. 20-2012-0005148, entitled Bag with Strap Tightener, discloses a bag with a strap tightener, which has a back plate, side plates and bag straps to receive objects. The bag straps are classified into a shoulder strap secured to an upper portion of the back plate, and a waist strap secured to a lower portion of the back plate. The length-adjustable strap tightener connects the shoulder strap with the waist strap. Thus, the length of each bag strap may be adjusted by manipulating the strap tightener.

DOCUMENTS OF RELATED ART (Patent Document 1) Korean U.M. Registration No. 20-0189053

(Patent Document 1) Korean U.M. Application Publication No. 20-2012-0005148

SUMMARY OF THE INVENTION

However, the conventional bag is problematic in that the device or the structure for adjusting the bag strap is exposed to the outside, so that an appearance is not neat and exposed regions may be caught by surrounding objects (e.g. tree branches, guardrails, etc.) during movement, thus threatening the safety of the user.

Accordingly, the present invention has been made keeping in mind the above problems occurring in the related art, and the present invention is intended to propose a bag, in which the length of a bag strap used to hold the bag on a user's body is easily adjustable and an adjusted region is not exposed to the outside, thus enabling a neat appearance to be reliably maintained and allowing the bag to be safely used.

In order to accomplish the above object, the present invention is intended to propose a bag having a sack-shaped main body configured to receive objects therein, and a bag strap normally connected to the main body and used to hold the bag on a user's shoulder, waist or the like, wherein a first end of the bag strap is coupled to a first end of the main body, a wire of a predetermined length is connected to a second end of the bag strap, and the main body includes an adjusting means that adjusts the length of the wire by winding or unwinding, in the state where an end of the wire is fixed.

The adjusting means may be disposed on a region of the main body to which the first end of the bag strap may be coupled, and the wire may be fixedly connected to the adjusting means after passing through an interior of the main body, via the second end that may be symmetric with the region to which the first end of the bag strap may be coupled, so that the length of the wire may be adjusted in the main body.

The adjusting means may include a body secured to the main body, with a shaft being provided on a central portion thereof; a winding ring holding the end of the wire and rotatably secured to the shaft of the body; and a locking member provided on the body to stop or release the rotation of the winding ring.

As described above, the present invention provides a bag, in which an entire length is adjusted by a wire that is adjusted in length by an adjusting means, so that it is possible to adjust the entire length of a bag strap as desired, and in which the length of the wire is adjusted particularly while being located in a main body, so that the wire is not exposed to the outside, thus always enabling a neat appearance to be reliably maintained, and so that the wire is not caught by surrounding protrusions such as tree branches or guardrails, thus guaranteeing a safe use.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF PREFERRED EMBODIMENTS

Figure 1:
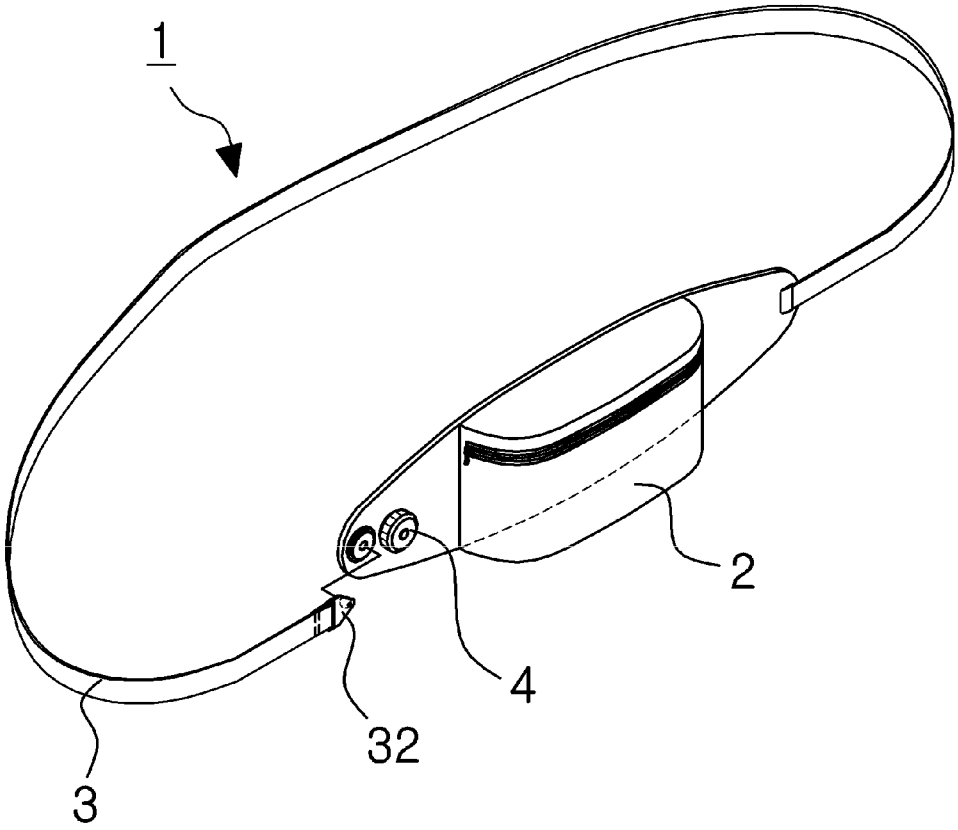
FIG. 1 is a schematic perspective view illustrating a bag according to an embodiment of the present invention.

Hereinafter, a bag according to the preferred embodiment of the present invention will be described in detail with reference to the accompanying drawings.

The present invention may be embodied in different forms and should not be construed as being limited to the embodiments set forth herein. Rather, these embodiments are provided so that this disclosure will be thorough and complete, and will fully convey the scope of the embodiments to those skilled in the art. In the drawings, shapes and dimensions of elements may be exaggerated for clarity of illustration. It should be noted that like reference numerals refer to like elements. When it is determined that the detailed description of the related art may obscure the gist of the present invention, the detailed description thereof will be omitted herein.

Figure 2:
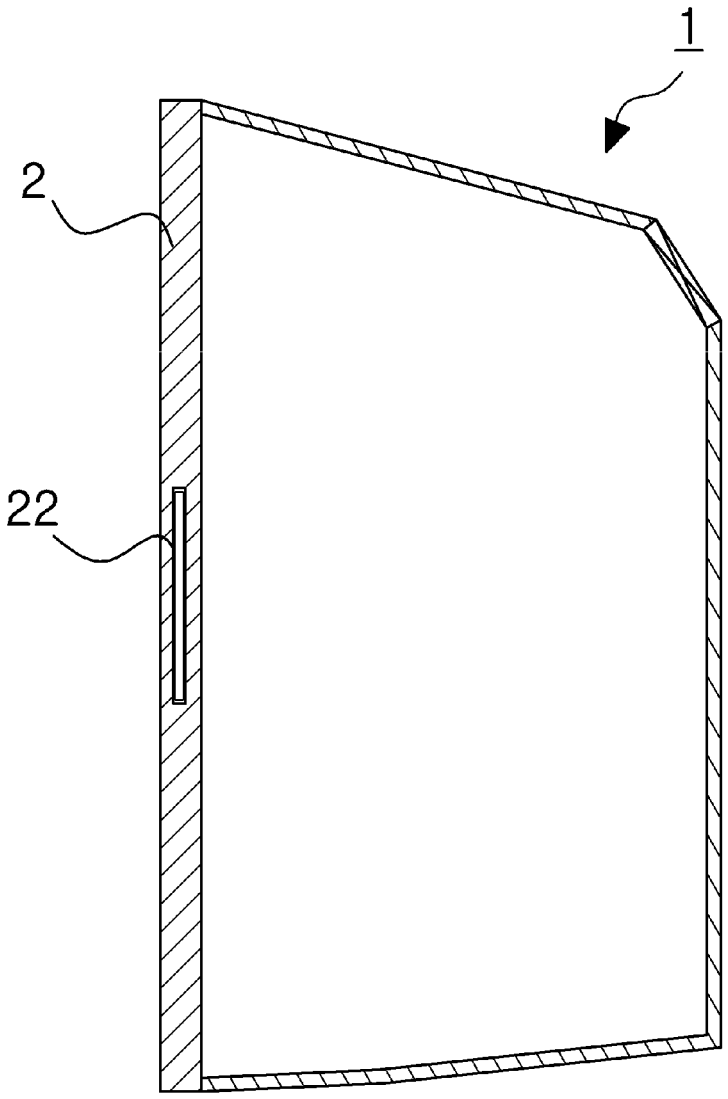
FIG. 2 is a schematic side sectional view illustrating the bag according to the embodiment.
Figure 3:
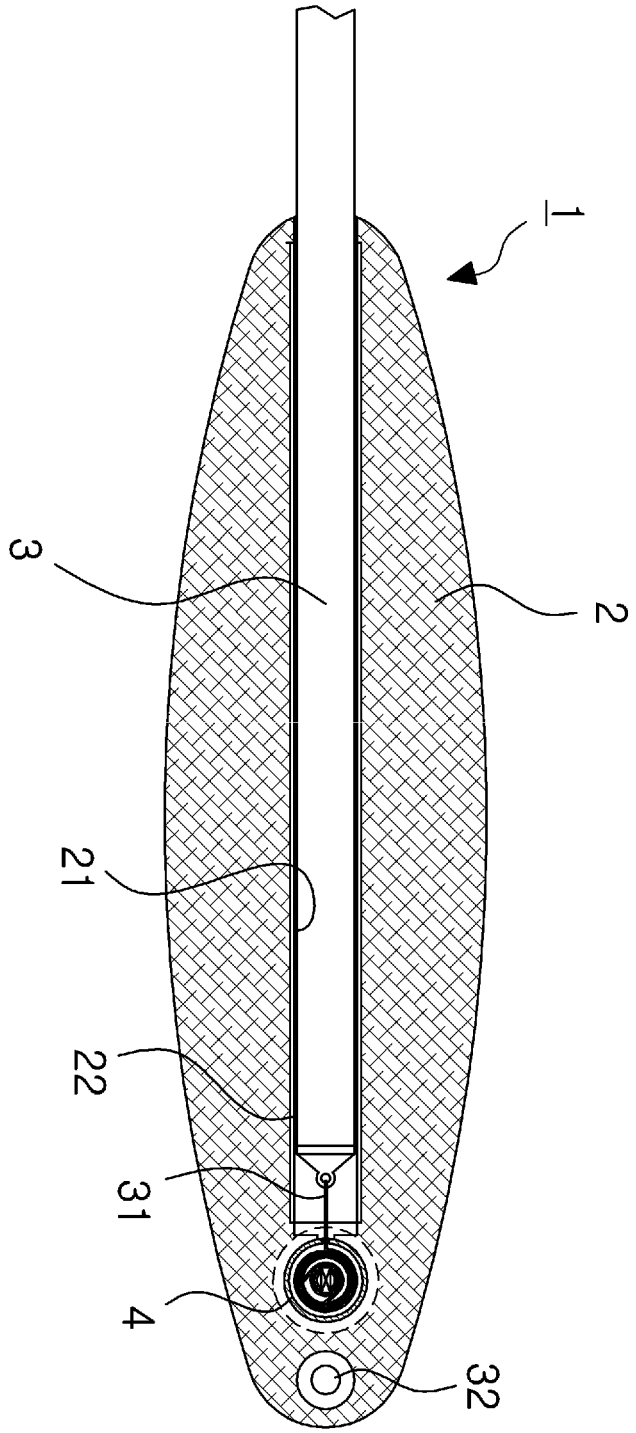
FIG. 3 is a schematic view illustrating the arrangement of an adjusting means applied to the bag according to the embodiment.
Figure 4:
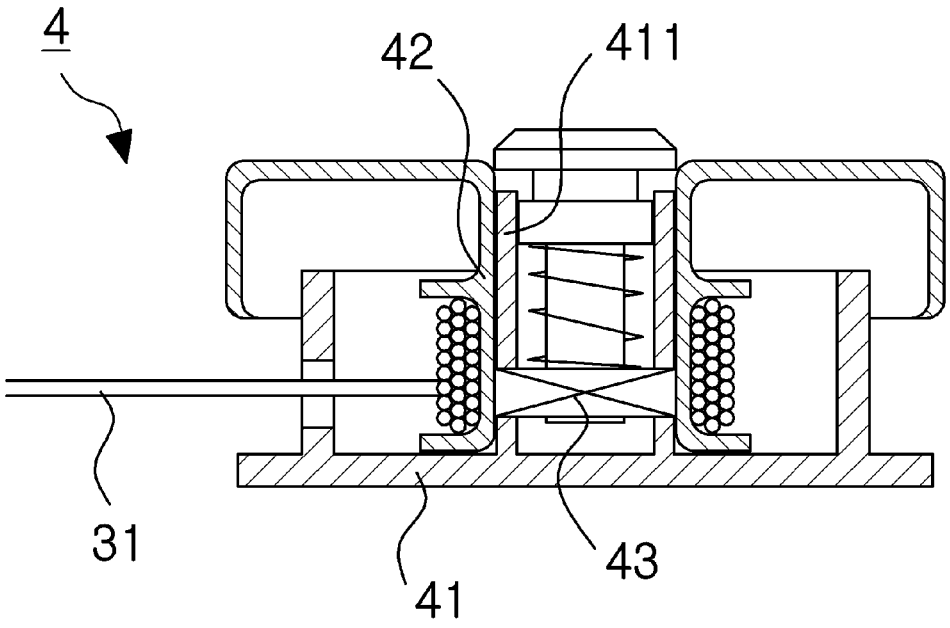
FIGS. 4 and 5 are schematic sectional views illustrating the adjusting means applied to the bag according to the embodiment.
Figure 5:
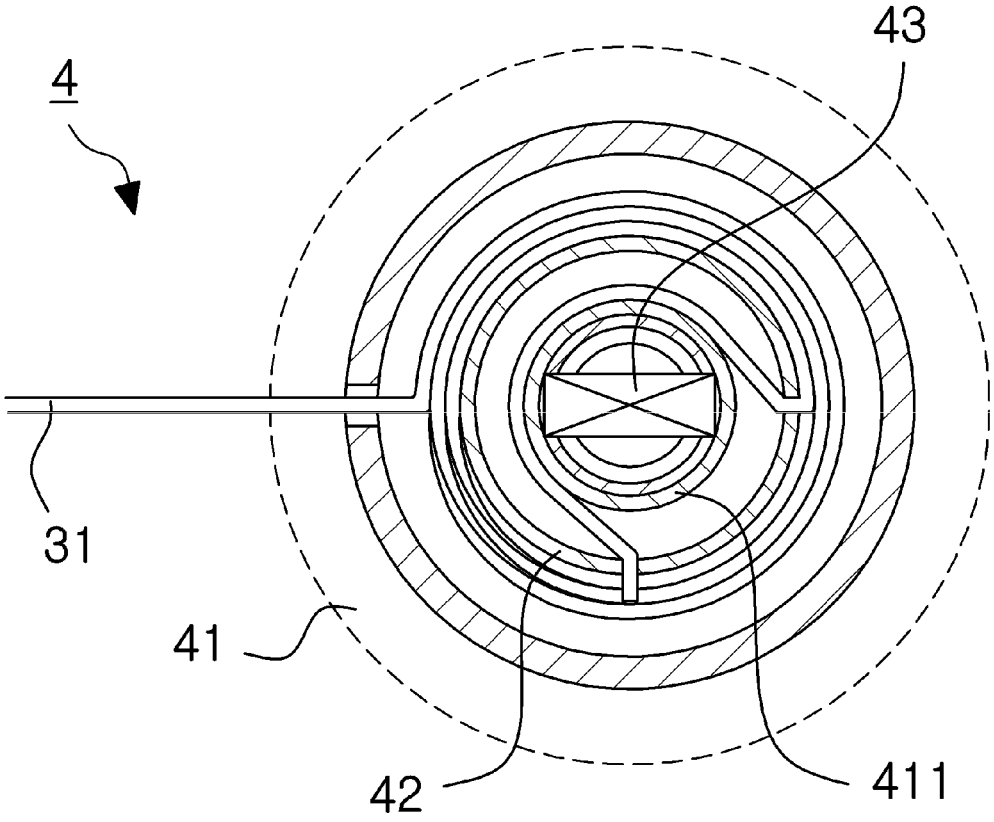
Figure 6:
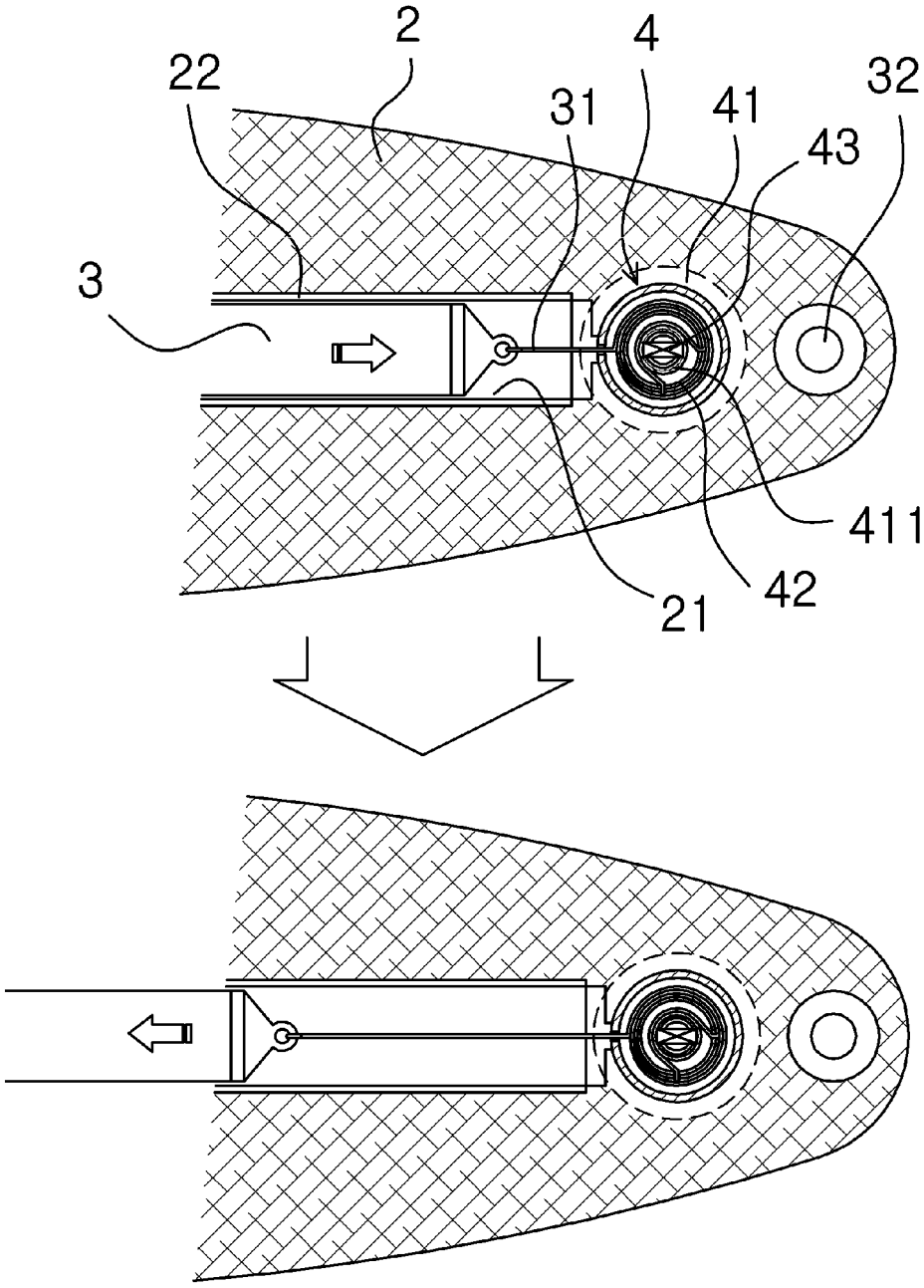
FIG. 6 is a schematic view illustrating the operation of the adjusting means applied to the bag according to the embodiment.

FIGS. 1 to 6 illustrate a bag according to an embodiment of the present invention. The bag 1 according to the embodiment includes a sack-shaped main body 2 configured to receive objects therein, and a bag strap 3 normally connected to the main body 2 and used to hold the bag 1 on a user's shoulder, waist or the like.

That is, after the objects are put into the main body 2, the bag 1 is carried by holding it with the hand or the shoulder using the bag strap 3.

In this respect, the main body 2 has various shapes depending on its purpose, for example, a backpack for climbing, a school bag, a bag bound around the waist, etc.

In the bag 1 according to this embodiment, one end of the bag strap 3 is connected to one end of the main body 2, with a wire 31 of a predetermined length being connected to the other end of the bag strap 3.

The main body 2 is provided with an adjusting means 4 that adjusts the length of the wire 31 by winding or unwinding, in the state where an end of the wire 31 is fixed.

In other words, the entire exposed length of the bag strap 3 is adjusted by regulating a connection length of the wire 31 to the bag strap 3 using the adjusting means 4, so that it is possible to regulate the length of the bag strap 3 as desired.

Here, one end of the bag strap 3 may be reliably fixed to the main body 2. It is not preferable to fasten or unfasten the bag strap 3 to or from the main body 2 preferably using a fastening element 32 such as a buckle or a snap fastener.

That is, one end of the bag strap 3 is fixedly connected to the main body 2 through the wire 31, while the other end is detachably coupled to the main body 2 through the fastening element 32, thus allowing a more convenient use when the bag is worn.

In the bag 1 according to the embodiment configured as such, the adjusting means 4 is disposed on a region of the main body 2 to which one end of the bag strap 3 is coupled. The wire 31 is fixedly connected to the adjusting means 4 after passing through an interior of the main body 2, via the other end that is symmetric with the region to which one end of the bag strap 3 is coupled.

That is, the adjustment of the exposed length of the wire 31 relative to the adjusting means 4 is performed in the main body 2.

Thus, as the wire 31 is adjusted in length while being located in the main body 2, the wire 31 is not exposed to the outside, so that it is possible to always reliably maintain the neat appearance Since the wire 31 is not exposed to the outside, the wire is not caught by surrounding protrusions such as tree branches or guardrails, thus guaranteeing a safe use.

Preferably, a guide tube 22 made of fabric or elastic rubber material is disposed in the main body 2, and has a guide hole 21 to receive and guide the wire 31 and one end of the bag strap 3.

That is, when the exposed length of the bag strap 3 is adjusted, the bag strap 3 is rectilinearly reciprocated while being guided in the guide tube 22.

Therefore, the bag strap 3 may keep a stable posture without being twisted or shaken.

In the bag 1 according to this embodiment, the adjusting means 4 includes a body 41 that is secured to the main body 2 and has on a central portion thereof a shaft 411, a winding ring 42 that holds the end of the wire 31 and is rotatably secured to the shaft 411 of the body 41, and a locking member 43 that is provided on the body 41 to stop or release the rotation of the winding ring 42.

As the winding ring 42, which is braked by driving the locking member 43, is rotated, the wire 31 is wound or unwound, so that the exposed length of the wire 31 is adjusted, and consequently the entire exposed length of the bag strap 3 is adjusted.

In this regard, the locking member 43 is configured to lock or unlock the winding ring 42 to or from the shaft 411. As the locking member 43, a desired structure selected by a user is preferably adopted, and a dial-spool structure constituting BOA technology is most preferably adopted.

In the case of carrying or conveying objects using the bag 1 according to this embodiment configured as such, the objects are first put into the main body 2 through the opening thereof, and then the bag 1 is worn by tying the bag strap 3 to the waist or the back using the fastening element 32.

If the bag 1 has been worn as such, the winding ring 42 of the adjusting means 4 is rotated to wind or unwind the wire 31 and thereby adjust its exposed length. In this way, the entire exposed length of the bag strap 3 is adjusted as desired, so that it is possible to stably wear the bag 1.

In the bag 1 according to this embodiment, the exposed length of the wire 31 is adjusted while the wire 31 is located in the main body 2. As a result, the wire 31 is not exposed to the outside of the main body 2, thus guaranteeing a stable use.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A shoulder or waist strap bag, comprising:

a sack-shaped main body configured to receive objects therein, the main body comprising, adjusting means that adjusts a length of a wire, and a straight-shaped guide tube made of fabric or elastic rubber material being disposed across the main body; and a bag strap, a first end of the bag strap being coupled to a first end of the main body, and a second end of the bag strap being connected to a first end of the wire, wherein a second end of the wire is fixed to a winding ring for winding or unwinding of the wire comprised of the adjusting means, wherein the guide tube has a guide hole configured to receive and guide the first end of the wire and the second end of the bag strap so that the bag strap is rectilinearly reciprocated while being guided in the guide tube, wherein a length of an exposed portion of the bag strap is adjusted by the length of the wire.

2. The bag of claim 1, wherein the adjusting means is disposed on a region of the main body to which the first end of the bag strap is coupled, and the first end of the bag strap is coupled to the first end of the main body by a fastening element.

3. The bag of claim 1, wherein the adjusting means comprises:

a body secured to the main body, with a shaft being provided on a central portion thereof;

the winding ring holding the end of the wire and rotatably secured to the shaft of the body; and a locking member provided on the body to stop or release rotation of the winding ring.

4. The bag of claim 1, wherein the adjusting means adopts a dial-spool structure.

* * * * *